US006712063B1

(12) United States Patent
Thorneywork

(10) Patent No.: US 6,712,063 B1
(45) Date of Patent: Mar. 30, 2004

(54) OVENS WITH CATALYTIC CONVERTERS

(75) Inventor: Nigel Thorneywork, Normandy (GB)

(73) Assignee: Merrychef Limited (GB)

( * ) Notice: Subject to any disclaimer, the term of this patent is extended or adjusted under 35 U.S.C. 154(b) by 0 days.

(21) Appl. No.: 09/564,622

(22) Filed: May 4, 2000

(30) Foreign Application Priority Data

Nov. 20, 1999 (GB) ..... 9927368

(51) Int. Cl.[7] ..... F24C 15/32; H05B 6/64

(52) U.S. Cl. ..... 126/21 A; 219/757; 219/681; 219/400

(58) Field of Search ..... 126/21 R, 21 A, 126/19 R, 15 R, 15 A, 299 D, 299 R, 299 F; 219/757, 754, 400, 444, 681, 680

(56) References Cited

U.S. PATENT DOCUMENTS

| | | | | |
|---|---|---|---|---|
| 4,350,504 A | | 9/1982 | Diachuk | 55/217 |
| 4,494,525 A | * | 1/1985 | Albertsen | 126/289 |
| 4,547,642 A | * | 10/1985 | Smith | 126/21 A |
| 4,786,774 A | * | 11/1988 | Kaminaka | 219/757 |
| 5,483,044 A | * | 1/1996 | Thorneywork et al. | 126/21 A |
| 5,886,330 A | * | 3/1999 | Kang et al. | 219/757 |
| 5,927,265 A | | 7/1999 | McKee et al. | 126/21 |
| 6,058,924 A | * | 5/2000 | Pool, III et al. | 126/21 A |
| 6,131,559 A | * | 10/2000 | Norris et al. | 126/21 A |

FOREIGN PATENT DOCUMENTS

| | | |
|---|---|---|
| FR | 2739791 | 10/1995 |
| GB | 2337104 A | 11/1999 |
| WO | 9854517 | 12/1998 |

OTHER PUBLICATIONS

Search Report, Application No. GB9927368.2, Date of Search– Jan. 17, 2000.

International Search Report regarding International Application No. PCT/GB00/04156 issued Feb. 21, 2001.

Great Britain Search Report regarding Great Britain Application No. 0016987.0 issued Aug. 15, 2000.

* cited by examiner

*Primary Examiner*—Josiah Cocks
(74) *Attorney, Agent, or Firm*—Ohlandt, Greeley, Ruggiero & Perle, LLP

(57) ABSTRACT

An oven 2 comprises a number of chamber walls (6, 8, 10, 12, 14) defining a cooking chamber 4, heating means 20 for heating food within the cooking chamber 4, at least one opening 22, 24 in at least one of the chamber walls, fan means 26, 28 for driving air out of the cooking chamber 4 through said opening 22, 24, a grease filter 34, 36 located downstream of said opening 22, 24, and a catalytic converter 38, 40 located downstream of said grease filter 34, 36 and within 20 centimeters of said grease filter 34, 36.

31 Claims, 1 Drawing Sheet

OVENS WITH CATALYTIC CONVERTERS

BACKGROUND OF THE INVENTION

The invention relates to ovens with catalytic converters for removing airborne grease particles. The invention relates to any type of oven, but is particularly applicable to microwave combination ovens.

It is known to use catalytic converters in ovens in order to flamelessly oxidise oxidisable components in the hot air from the cooking chamber. For example, a recycling oven using such a catalytic converter is described in International Patent Application Number PCT/US98/10736. In this oven hot air from the cooking chamber is passed through a catalytic converter before being returned to the cooking chamber.

One disadvantage of the arrangement described in international application number PCTIUS98/10736 is that daily cleaning is required for the ducting which directs hot air from the cooking chamber to the catalytic converter. A further disadvantage is that the air-flow within the cooking chamber is somewhat uneven.

The present invention seeks to overcome at least some of the disadvantages of the prior art.

SUMMARY OF THE INVENTION

According to the invention there is provided an oven comprising a number of chamber walls defining a cooking chamber, heating means for heating food within the cooking chamber, at least one opening in at least one of the chamber walls, fan means for driving air out of the cooking chamber through said opening, a grease filter attached substantially directly to the one of the chamber walls and a catalytic converter located downstream of said grease filter.

It will be appreciated that, because the grease filter is placed close to the cooking chamber, the labour involved in cleaning any ducting leading to the grease filter, required in the prior art, is avoided.

In different embodiments, the catalytic converter is located within 20, 10 or 5 centimeters of said opening.

The catalytic converter may be located substantially immediately adjacent the grease filter.

In a preferred embodiment there are no other components between the catalytic converter and the opening except the grease filter.

Conveniently, the air which is driven out of the cooking chamber is recirculated back into the cooking chamber after passing through the catalytic converter.

The oven may be a microwave combination oven. In such ovens heating of the food is achieved by a combination of microwave energy and electric heating elements.

There may be two such openings each provided with a catalytic converter having the features described above.

In this case, each opening may be provided with a separate fan.

The openings may be provided in opposite side walls of the oven.

An electric heating element may be provided to heat air in the cooking chamber.

The heating element may also be arranged to emit infrared radiation directly onto food within the cooking chamber.

In this case the electric heating element may be provided directly behind one of the chamber walls which is provided with perforations which allow the chamber wall both to transmit infrared radiation from the electric heating element and to reflect microwave radiation back into the cooking chamber.

The oven may further comprise a rotatably driven turntable for rotating food to be cooked within the cooking chamber.

The invention will now be more particularly described, by way of example only, with reference to the accompanying figures, which show two embodiments of microwave combination ovens constructed in accordance with the invention.

DETAILED DESCRIPTION

Figure 1:
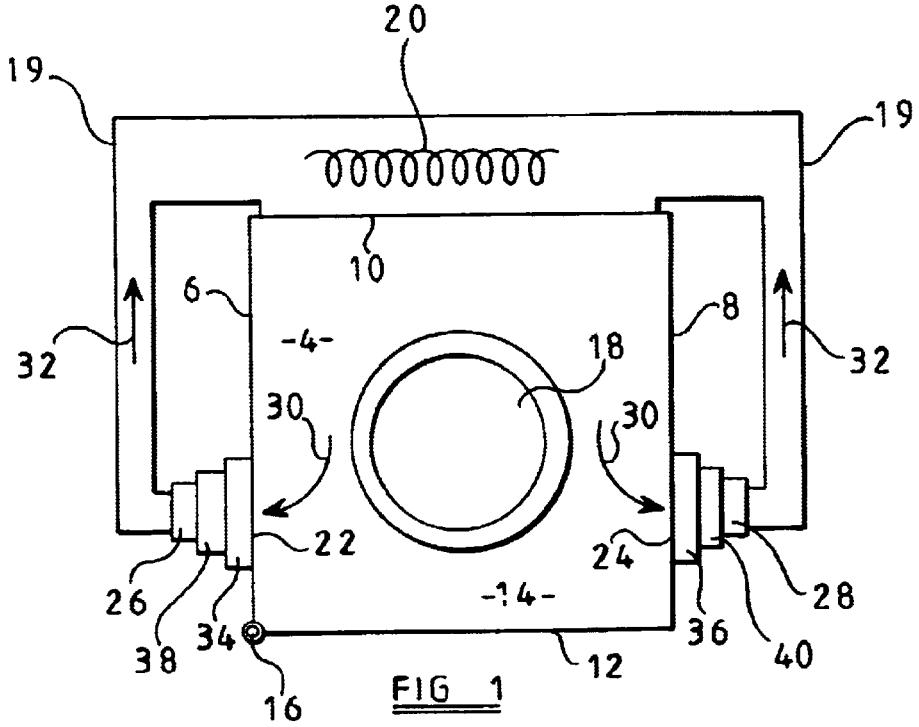
FIG. 1 shows a microwave combination oven provided with two air outlets.

FIG. 1 shows a cross-sectional view of a microwave combination oven 2 viewed in schematic form from above. The oven 2 comprises a cooking chamber 4 defined by two side walls 6 and 8, a rear wall 10, a front door 12, a base 14, and an upper wall (not shown) connected to the side walls 6 and 8 and the rear wall 10 above the base 14. The front door 12 is hinged to the side wall 6 by hinges 16, and can be opened to gain access to the cooking chamber 4.

A rotating turntable 18 is mounted on the base 14 in known manner. Food within the cooking chamber 4 can be cooked by microwave energy provided by a microwave source (not shown) or by an electric heating element 20, or by a combination of both in known manner. It is for this reason that such ovens are referred to as "combination" ovens.

In order to allow infrared radiation from the heating element 20 to fall directly on the food to be cooked, the rear wall 10 is provided with a plurality of perforations (not shown) and the heating element 20 is located directly behind the rear wall 10. Furthermore, the inside surfaces of the walls of the cooking chamber 4 are formed from reflective stainless steel, which ensures that infrared radiation from the heating element 20 bounces around within the cooking chamber 4 in order to reach the food on the turntable 18 from substantially all directions. It will be appreciated that such infrared radiation is useful in browning the surface of the food to be cooked, if this is required.

The side walls 6 and 8 are provided with respective side openings 22 and 24. Two fans 26 and 28 are provided for circulating air from within the cooking chamber 4. The air is drawn out of the cooking chamber 4 through the two openings 22 and 24, and re-enters the cooking chamber through the perforations formed in the rear wall 10. Ducting 19 is provided to direct the air from the fans 26 and 28 to the rear wall 10. The flow path of the air is illustrated by arrows 30 within the cooking chamber 4, and by arrows 32 outside of the cooking chamber 4.

The side openings 22 and 24 are provided with grease filters 34 and 36 attached to the side walls 6 and 8 respectively. These filters filter out large splatters of grease from food being cooked within the cooking chamber 4. The grease filters 34 and 36 can be of any suitable type, including paper or electrostatic grease filters. The fact that grease filters 34 and 36 are attached to the side walls 6 and 8 avoids the need to clean any ducting between the side walls 6 and 8 and the grease filters 34 and 36, as is necessary in the prior art mentioned above.

Catalytic converters 38 and 40 are attached directly to the grease filters 34 and 36 in order to flamelessly oxidise oxidisable components in the hot air which has passed through the grease filters 34 and 36. This process also releases additional heat, which assists the cooking process. The catalytic converters 38 and 40 are formed from a metallic monolith containing the elements Iron, Chromium and Aluminium, onto which is deposited a catalytic coating containing Platinum together with one or more elements in the Lanthanide Series.

It will be appreciated that because the catalytic converters 38 and 40 are attached directly to the grease filters 34 and 36 there is no ducting leading to the catalytic converters 38 and 40 from the cooking chamber 4, and the labour involved in cleaning such ducting is therefore avoided. There may of course be some ducting between the grease filters 34 and 36 and the catalytic converters 38 and 40, but this should be kept to a minimum, and is ideally less than 20 cm. In this embodiment of the invention, the catalytic converters 38 and 40 are spaced approximately 2.5 cm from the openings 22 and 24.

The fans 26 and 28 are connected directly behind tho catalytic converters 38 and 40.

The cooking chamber 4 has a height of 31.5 cm, a depth of 33 cm, and a width of 33 cm. The side openings 22 and 24 are substantially circular, of diameter about 13 cm, and are formed by perforating the side walls 6 and 8 by circular holes of diameter 4.2 mm. A number of areas of similar perforations are also used in the rear wall 10. These perforations allow the flow of air, while ensuring reflection of microwave radiation.

Figure 2:
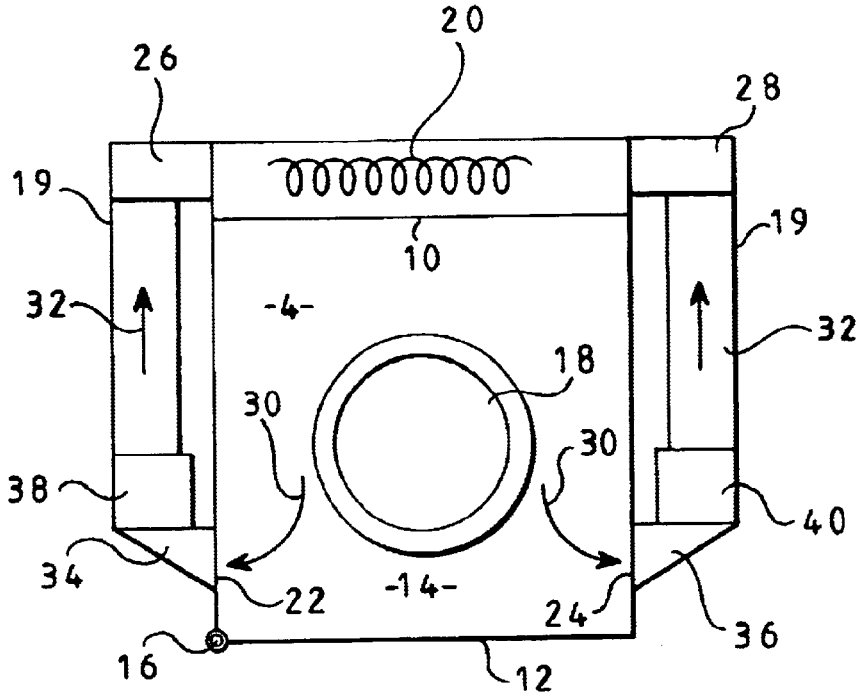
FIG. 2 shows a second embodiment in which the fans are located at the rear of the oven.

In the second embodiment shown in FIG. 2 like parts are given like reference numbers. The fans 26 and 28 are located towards the rear of the oven. The openings 22 and 24 are provided with triangular shaped grease filters 34 and 36 attached to the side walls 6 and 8 respectively. The catalytic converters 38 and 40 are attached directly to the grease filters 34 and 36. This arrangement allows a more compact oven to be produced whilst ensuring that the ducting 19 remains free from any grease contamination.

It will also be appreciated that because there are two openings in the side walls of the cooking chamber 4, each provided with a separate fan, the air-flow within the cooking chamber 4 is more even, and the food within the cooking chamber 4 cooks more evenly, than would be the case if only a single opening was provided. However, ovens having only a single opening are also included within the scope of the invention.

What I claim is:

1. A recirculating microwave combination oven comprising a number of chamber walls defining a substantially closed cooking chamber, microwave heating means for heating food within the cooking chamber, at least one opening disposed in at least one of the chamber walls, wherein said at least one chamber wall is a side wall, fan means for driving air out of the cooking chamber through said opening, a grease filter attached substantially directly to said side wall at said opening, and a catalytic converter located downstream of said grease filter.

2. An oven as claimed in claim 1, wherein the catalytic converter is located within 20 centimeters of said opening.

3. An oven as claimed in claim 1, wherein the catalytic converter is located within 20 centimeters of said opening.

4. An oven as claimed in claim 1, wherein the catalytic converter is located within 5 centimeters of said opening.

5. An oven as claimed in claim 1, wherein the catalytic converter is located substantially immediately adjacent the grease filter.

6. An oven as claimed in claim 5, wherein there are no other components between the catalytic converter and the opening except the grease filter.

7. An oven as claimed in claim 1, wherein said air which is driven out of the cooking chamber is recirculated back into the cooking chamber after passing through the catalytic converter.

8. The oven as claimed in claim 1, wherein said heating means includes an electric heater for heating said air and a source for providing microwave energy to said cooking chamber.

9. An oven as claimed in claim 1, which is provided with at least a second openings, each of said openings being provided with a catalytic converter.

10. An oven as claimed in claim 9, wherein each opening is provided with a separate fan.

11. An oven as claimed in claim 9, wherein the openings are provided in opposite side walls of the oven.

12. An oven as claimed in claim 1, wherein an electric heating element is provided to heat air in the cooking chamber.

13. An oven as claimed in claim 12, wherein the heating element is arranged to emit infrared radiation directly onto food within the cooking chamber.

14. An oven as claimed in claim 13, wherein the electric heating element is provided directly behind one of the chamber walls which is provided with perforations which allow the chamber wall both to transmit infrared radiation from the electric heating element and to reflect microwave radiation back into the cooking chamber.

15. An oven as claimed in claim 1 which further comprises a rotably driven turntable for rotating food to be cooked within the cooking chamber.

16. The oven as claimed in claim 1, wherein said chamber walls include a rear wall, and wherein said fan means recirculates air through said cooking chamber via said rear wall.

17. An oven comprising a number of chamber walls defining a cooking chamber, heating means for heating food within the cooking chamber, at least two openings in the chamber walls, and fan means for driving air out of the cooking chamber through said openings, wherein each opening is provided with a grease filter located downstream of the opening, and a catalytic converter located downstream of the grease filter, wherein two of said chamber walls form a pair of opposite side walls of the oven, and wherein the openings are provided in said pair of opposite side walls.

18. An oven as claimed in claim 17, wherein each grease filter is attached substantially directly to one of the chamber walls.

19. An oven as claimed in claim 17, wherein each catalytic converter is located within 20 centimeters of its respective opening.

20. An oven as claimed in claim 17, wherein each catalytic converter in located within 10 centimeters of its respective opening.

21. An oven as claimed in claim 17, wherein each catalytic converter is located within 5 centimeters of its respective opening.

22. An oven as claimed in claim 17, wherein each catalytic converter is located substantially immediately adjacent its respective grease filter.

23. An oven as claimed in claim 22, wherein there are no other components between each catalytic converter and its respective opening except one of the grease filters.

24. An oven as claimed in claim 17, wherein said air which is driven out of the cooking chamber is recirculated back into the cooking chamber after passing through the catalytic converter.

25. An oven as claimed in claim 17 which is a microwave combination oven.

26. An oven as claimed in claim 17, wherein an electric h eating element is provided to heat air in the cooking chamber.

27. An oven as claimed in claim 26, wherein the heating element is arranged to emit infared radiation directly onto food within the cooking chamber.

28. An oven as claimed in claim 27, wherein the electric heating element is provided directly behind one of the chamber walls which is provided with perforations which allow the chamber wall both to transmit infrared radiation from the electric heating element and to reflect microwave radiation back into the cooking chamber.

29. An oven as claimed in claim 17, which further comprises a rotably driven turntable for rotating food to be cooked within the cooking chamber.

30. The oven as claimed in claim 17, wherein each opening is provided with a separate fan.

31. The oven as claimed in claim 17, wherein said oven is a recirculating microwave combination oven.

* * * * *